US005329997A

United States Patent [19]

Bayer et al.

[11] Patent Number: 5,329,997

[45] Date of Patent: Jul. 19, 1994

[54] HEAT EXCHANGER

[75] Inventors: Juergen Bayer, Esslingen; Dieter Engelhardt, Stuttgart; Prasanta Halder, Ditzingen, all of Fed. Rep. of Germany

[73] Assignee: Behr GmbH & Co., Stuttgart, Fed. Rep. of Germany

[21] Appl. No.: 39,130

[22] Filed: Apr. 16, 1993

[30] Foreign Application Priority Data

Dec. 1, 1990 [DE] Fed. Rep. of Germany ... 9016381[U]

[51] Int. Cl.[5] ..... F28F 9/04

[52] U.S. Cl. ..... 165/173; 165/905

[58] Field of Search ..... 165/153, 173, 905; 29/890.043

[56] References Cited

U.S. PATENT DOCUMENTS 4,586,566 5/1986 Kern et al. ..... 165/173
4,724,903 2/1988 Bayer et al. ..... 165/173
4,739,828 4/1988 Bayer et al. ..... 165/173

FOREIGN PATENT DOCUMENTS 136987 8/1983 Japan ..... 29/890.043
2180634 4/1987 United Kingdom .

*Primary Examiner*—John Rivell
*Assistant Examiner*—L. R. Leo
*Attorney, Agent, or Firm*—Foley & Lardner

[57] ABSTRACT

A heat exchanger (1) with at least one heat-exchange tube (11) which is held at the end in an end piece (3) such that the joint is liquid- and gas-tight. The end piece (3) has an opening for each tube to which it is connected, allowing the heat-exchange fluid to pass through from the tube (11) into a conduit box and in the opposite direction, a sleeve-like connection socket (8) being located in the region of each opening. The connection socket (8) comprises a cylindrical slot (9) coaxial to the opening and open at the heat-exchange tube end, forming an inner (14) and outer (15) annular wall. The end of the heat-exchange tube (11) is pushed into the slot. A section of the outer annular wall (15) adjacent to the heat-exchange block is longer than the corresponding section of the inner annular wall (14).

12 Claims, 4 Drawing Sheets

8
7
3
9
14
15
18
z
d
a
R1
R2
14*
y
b
c
15*
17
x
16
11*
S0
S2
S1

HEAT EXCHANGER

The invention relates to a heat exchanger having at least one heat-exchanger tube, of the generic type specified in the preamble of claim 1.

From DE-A-36 19 265, a heat exchanger is known in which the heat-exchanger tubes are held, at the end, in a liquid-tight or gas-tight manner in a plastics base. The tube connections exhibit connecting sockets having an annular groove located therein, into which groove the ends of the heat-exchanger tubes are pressed. For easy centering of the tube, an inner ring formed by the annular groove is of lengthened construction and is provided with a sloping face.

The production reliability of these known heat exchangers depends partly however upon the materials used, in particular the metal of the heat-exchanger tubes, and upon the cross-sectional shape of the tubes. In tubes of oval cross section, kinks can sometimes arise in the tube.

The object of the present invention is therefore to refine a heat exchanger of the generic type defined in the preamble of claim 1, such that, irrespective of the tube material used and the cross-sectional shape of the tube, buckles or kinks are prevented.

This object is achieved in a heat exchanger of the defined type by the characterizing features of claim 1. Advantageous designs of the subject of the invention consist in the outer ring being provided, at its end facing the heat-exchanger block, with an arc-shaped widening and/or the inner ring, at the open end of the annular groove, possessing a curvature, so that the annular groove is thereby widened in this area. This has the advantage that, when the tube end is being pressed in, the compression force continuously increases up to the point at which the walls of the annular groove have a parallel progression.

Particularly in the case of tubular cross sections which are not circular, it can happen that the parting plane of the tube end is not exactly orthogonal in relation to the longitudinal axis of the tube, but exhibits, over the periphery, a deviation of a few tenths of a millimeter. This can result in the tube end not meeting the connecting socket simultaneously across its entire cross-sectional periphery, so that the force involved in the compression initially acts only against these bearing points. In order nevertheless to achieve an exact guidance in this case, it is advantageous for a wall area having an at least approximately cylindrical shape to be disposed between the arc-shaped widening and the principal section of the annular groove. Between the principal section of the annular groove and the cylindrical wall area, there is expediently provided a transitional section. A construction of this kind involves a stepped constriction of the annular gap. The effect of this is that the compression is initially built up against the outer ring and then against the inner ring of the plastics base, thereby preventing any pinching effect and achieving a linear force/distance pattern and a reduction in the compression force.

The axial length of the cylindrical section preferably measures 0.5 mm to 1 mm.

In order to compensate for production tolerances both in the tube base and in the heat-exchanger block and possibly for the axial offsetting of tube ends and connecting sockets, it is proposed that the end point of the widening and the end point of the curvature should exhibit, in relation to the longitudinal axis of the tube connection, a radial distance amounting to two to three times the tubular wall thickness of the heat-exchanger tube. In an orthogonal to the longitudinal axis of the connecting socket through the end point of the curvature, the radial distance between the widening and the curvature should amount to around 1.3 to 1.7 times the tubular wall thickness.

Illustrative embodiments of the invention are explained in greater detail below with reference to the drawing, in which.

and

Figure 2:
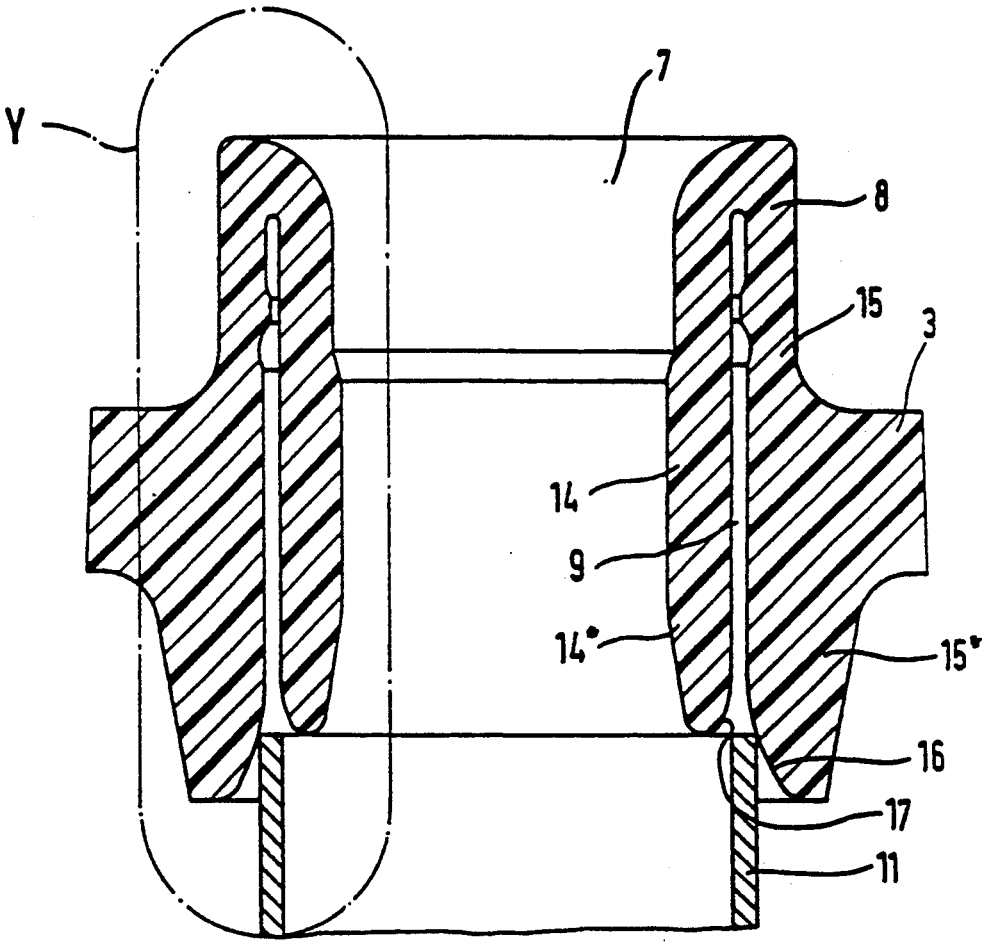
FIG. 2 shows an enlarged representation of the detail X in FIG. 1 prior to the compression of the tube end.
Figure 4:
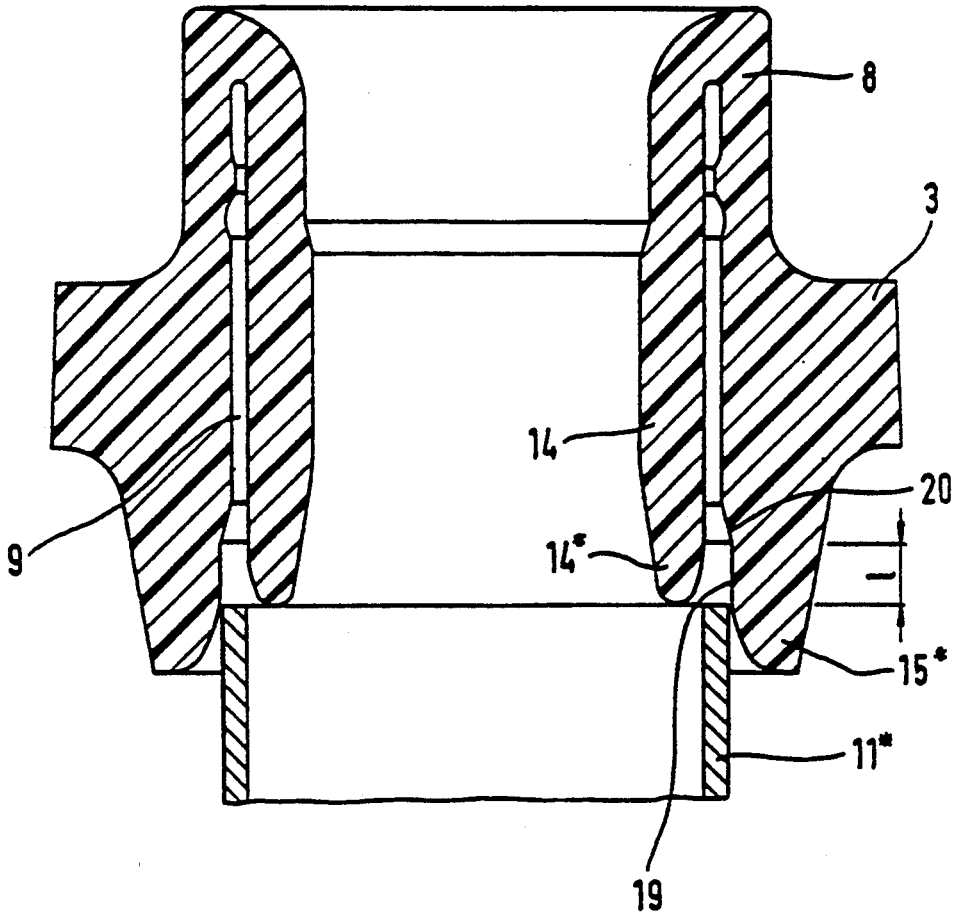

FIG. 4 shows a construction variant to FIG. 2.

Figure 1:
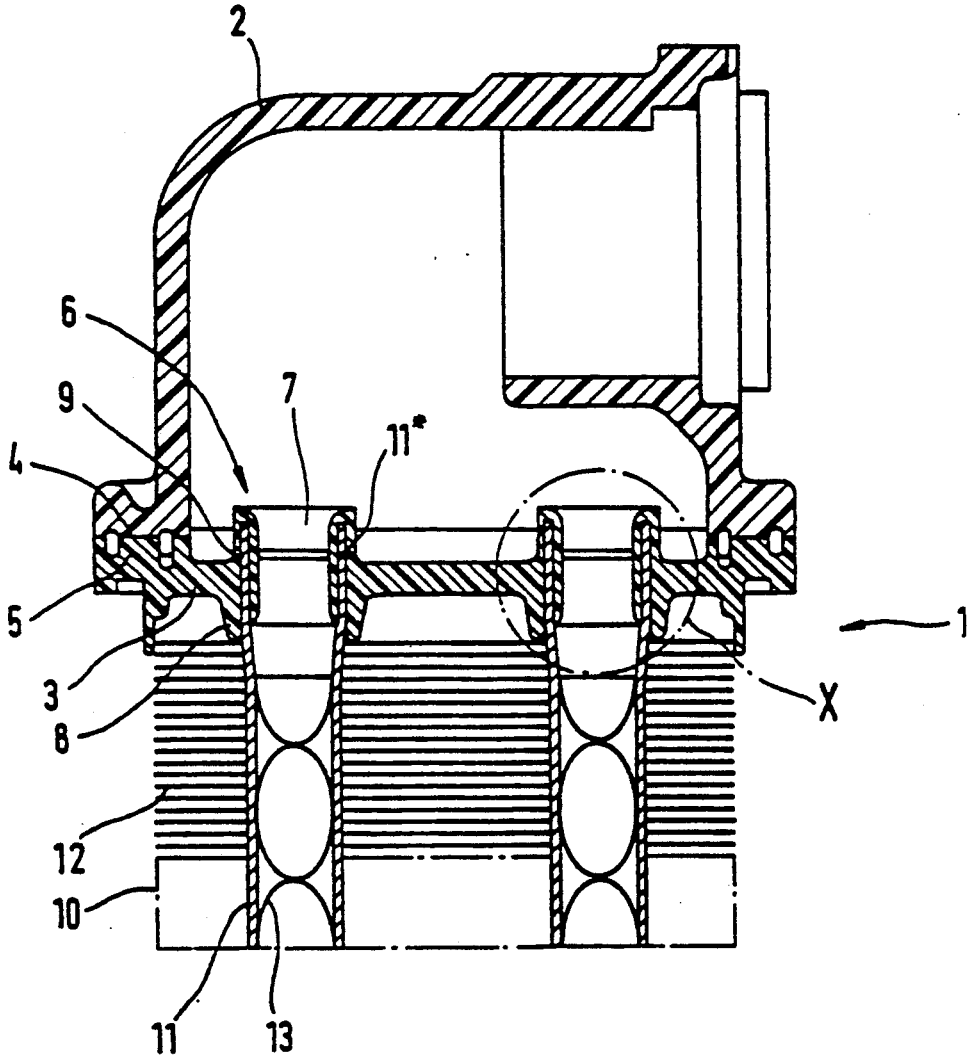
FIG. 1 shows a vertical section through an upper section of the heat exchanger.

In FIG. 1 a section of a heat exchanger 1 is represented which possesses a plastics water tank 2, a likewise plastics tube base 3 and a heat-exchanger block 10. The water tank 2 and the tube base 3 are bonded together at their marginal areas 4 and 5. The tube base 3 exhibits tube connections 6 having openings 7, the tube connections 6 in each case comprising a sleeve-shaped connecting socket 8 having an annular groove 9, which extends coaxially to the opening 7 and is open in the direction of the heat-exchanger block 10. The heat-exchanger block 10 is constructed from metallic heat-exchanger tubes 11 and ribs 12—likewise made from metal—disposed transversely thereto. Into the heat-exchanger tubes 11 there are inserted turbulence inlays 13. The ends 11* of the heat-exchanger tubes 11 are pressed into the annular grooves 9 of the connecting sockets 8.

FIG. 2 shows an enlarged representation of the detail X in FIG. 1, albeit in the state prior to the tube end 11* being pressed into the annular groove 9 of the connecting socket 8. It can be seen that the connecting socket 8—related to the annular groove 9 and hence also to the tube end 11*—comprises an inner ring 14 and an outer ring 15. The section 15* of the outer ring 15 which is adjacent to the heat-exchanger block is of longer construction than the corresponding section 14* of the inner ring 14 and on the radial inner wall this section 15* is provided, towards the end, with an arc-shaped widening 16. The inner ring 14 possesses a curvature 17 at the open end of the annular groove 9, so that the annular groove 9 is thereby also widened in this area.

Figure 3:
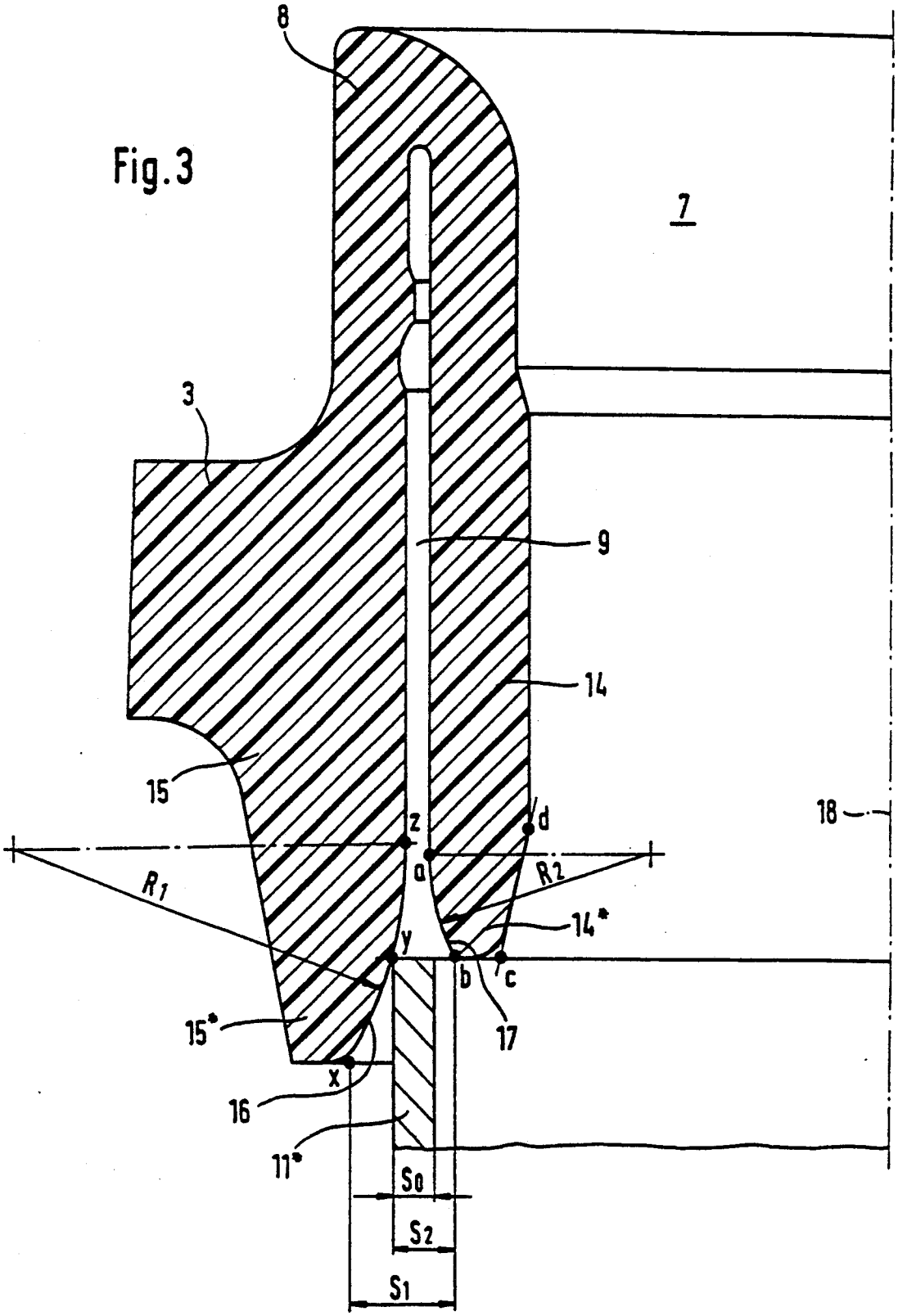
FIG. 3 shows an enlarged representation of the detail Y in FIG. 2.

In FIG. 3 the detail Y in FIG. 2 is shown, once again in enlarged representation. For identical parts, the reference symbols coincide with those in FIG. 2. The outer end of the arc-shaped widening 16 is denoted by the point x and at the point z the arc merges into a straight progression of the annular groove 9. The outer end of the curvature 17 is denoted by the point b, this arc merging at the point a into the straight progression of the annular groove 9. In a plane running orthogonally to the longitudinal extent of the tube socket 8, the point y on the curvature 16 lies opposite the point b on the curvature 17. The radial distance—related to the center axis 18 of the connecting socket 8 between the points b and x—is denoted by s1 and the radial distance between the points b and y by s2. Due to the smaller axial length of the inner ring 14 in relation to the outer ring 15, it turns out, when the tubes are being pressed in, that the tube end 11* initially comes to bear against the inner contour of the widening 16 and the centering of the tube ends 11* is effected in the area between the points x and y. The distance s1 minus s2 is dimensioned such that the production tolerance of the parts and the tolerance of the axial offsetting of the heat-exchanger tube 11 and the annular groove 9 does not have a detrimental effect. The two curvatures 16 and 17 serve to ensure that, when the tube ends 11* are being pressed in, the compression force continuously increases up to the point z. In FIG. 3, the tube wall thickness is denoted by the distance s0.

In FIG. 4 a construction variant to FIG. 2 is shown, for identical parts the reference symbols coinciding with those of FIG. 2. This representation shows that the arc-shaped widening 16 on the section 15* is initially adjoined by a wall area 19 having a cylindrical -or at least approximately cylindrical—progression. This cylindrical area 19 possesses an axial length 1 of ca. 0.5 to 1 mm, account also having to be taken, in determining this measure, of the respective diameter or cross section of the tube 11. Between the principal section of the annular groove 9 and the cylindrical area 19, there is provided a transitional section 20. The design according to FIG. 4 is particularly advantageous for tubes of an elliptical shape, since tubes of this type, at the start of the compression, are inclined to kink or buckle. By virtue of the area 19, a certain guide length is produced without any increase in force, thereby ensuring that the tube end 11* bears across the entire periphery of its front tube end against the wall of the section 15* before any significant compression forces are generated.

We claim:

1. Heat exchanger (1) having at least one tube connection and at least one heat-exchanger tube (11) which is held, at one end, in a liquid-tight or gas-tight manner in a plastic tube base (3), the tube base (3) exhibiting for each tube connection (6) an opening (7) for passage of heat-exchanger fluid from the tube (11) into a junction box (2) or in a reverse direction and the tube base (3) exhibiting, in an area of the opening (7), for each tube connection a sleeve-shaped connecting socket (8), in which there is disposed an annular groove (9), extending coaxially to the opening (7) and open in a direction of the heat-exchanger tube (11), by which annular groove an inner ring (14) and an outer ring (15) are formed and into which annular groove the end (11*) of the heat-exchanger tube (11) is pressed, characterized in that a section (15*) of the outer ring (15) which is adjacent to a heat-exchanger block (10) is of longer construction than a corresponding section (14*) of the inner ring (14).

2. Heat exchanger according to claim 1, characterized in that the outer ring (15) is provided, on its section (15*), with an arc-shaped widening (16) for receiving said tube, so that the annular groove is thereby widened.

3. Heat exchanger according to claim 2, characterized in that the inner ring, at the open end of the annular groove, possesses a curvature for receiving said tube, so that the annular groove is thereby widened.

4. Heat exchanger according to claim 1, characterized in that the inner ring (14), at the open end of the annular groove (9), possesses a curvature (17) for receiving said tube, so that the annular groove is thereby widened.

5. Heat exchanger according to claim 1, characterized in that said section of said inner ring and said section of said outer ring are respectively curved such that a continuous increase of a pressing force is required to insert said tube into said groove.

6. Heat exchanger (1) having are least one tube connection and at least one heat-exchanger tube (11) which is held, at one end, in a liquid-tight or gas-tight manner in a plastic tube base (3), the tube base (3) exhibiting for each tube connection (6) an opening (7) for passage of heat-exchanger fluid form the tube (11) into a junction box (2) or in a reverse direction and the tube base (3) exhibiting, in an area of the opening (7), for each tube connection a sleeve-shaped connecting socket (8), in which there is disposed an annular groove (9), extending coaxially to the opening (7) and open in a direction of the heat-exchanger tube (11), by which annular groove an inner ring (14) and an outer ring (15) are formed and into which annular groove the end (11*) of the heat-exchanger tube (11) is pressed, characterized in that a section (15*) of the outer ring (15) which is adjacent to a heat-exchanger block (10) is of longer construction than a corresponding section (14*) of the inner ring (14), characterized in that the outer ring (15) is provided on its section (15*), with an arc-shaped widening (16), characterized in that a wall area (19) having an at least approximately cylindrical shape is disposed between the arc-shaped widening (16) and a principal section of the annular groove (9).

7. Heat exchanger according to claim 6, characterized in that between the wall area (19) and the principal section of the annular groove (9), there is provided a transitional section (20).

8. Heat exchanger according to claim 6, characterized in hat an axial length (1) of the wall area (19) measures from 0.5 mm to 1 mm.

9. Heat exchanger (1) having at least one tube connection and at least one heat-exchanger tube (11) which is held, at one end, in a liquid-tight or gas-tight manner in a plastic tube base (3), the tube base (3) exhibiting for each tube connection (6) an opening (7) for passage of heat-exchanger fluid from the tube (11) into a junction box (2) or in a reverse direction and the tube base (3) exhibiting, in an area of the opening (7), for each tube connection a sleeve-shaped connecting socket (8), in which there is disposed an annular groove (9), extending coaxially to the opening (7) and open in a direction of the heat-exchanger tube (11), by which annular groove an inner ring (14) and an outer ring (15) are formed and into which annular groove the end (11*) of the heat-exchanger tube (11) is pressed, characterized in that a section (15*) of the outer ring (15) which is adjacent to a heat-exchanger block (10) is of longer construction than a corresponding section (14*) of the inner ring (14), characterized in that the outer ring (15) is provided, on its section (15*), with an arc-shaped widening (16), characterized in that an end point (x) of the widening (16) and an end point (b) of a curvature (17) of the inner ring exhibit, in relation to a longitudinal axis (18) of the tube connection (6), a radial distance (s1) amounting to two to three times a tubular wall thickness (s0) of the heat-exchanger tube (11).

10. Heat exchanger according to claim 9, characterized in that in an orthogonal to the longitudinal axis (18) of the connecting socket (6) through the end point (b) of the curvature (17), the radial distance (s2) between the widening (16) and the curvature (17) amounts to at least 1.3 times the tubular wall thickness (s0).

11. Heat exchanger (1) having at least one tube connection and at least one heat-exchanger tube (11) which is held, at one end, in a liquid-tight or gas-tight manner in a plastic tube base (3), the tube base (3) exhibiting for each tube connection (6) an opening (7) for passage of heat-exchanger fluid form the tube (11) into a junction box (2) or in a reverse direction and the tube base (3) exhibiting, in an area of the opening (7), for each tube connection a sleeve-shaped connecting socket (8), in which there is disposed an annular groove (9), extending coaxially to the opening (7) and open in a direction of the heat-exchanger tube (11), by which annular groove an inner ring (14) and an outer ring (15) are formed and into which annular groove the end (11*) of the heat-exchanger tube (11) is pressed, characterized in that a section (15*) of the outer ring (15) which is adjacent to a heat-exchanger block (10) is of longer construction than a corresponding section (14*) of the inner ring (14), characterized in that the inner ring (14), at the open end of the annular groove (9), possesses a curvature (17), so that the annular groove is thereby widened, characterized in that an end point (x) of the widening and an end point (b) of the curvature of the inner ring exhibit, in relation to a longitudinal axis of the tube connection, a radial distance (s1) amounting to two to three times a tubular wall thickness (s0) of the heat-exchanger tube.

12. Heat exchanger according to claim 11, characterized in that in an orthogonal to the longitudinal axis of the connecting socket through the end point (b) of the curvature, the radial distance (s2) between the widening and the curvature amounts to at least 1.3 times the tubular wall thickness (s0).

* * * * *